United States Patent [19]

Marschka

[11] 4,350,925

[45] Sep. 21, 1982

[54] MAIN LENS ASSEMBLY FOR AN ELECTRON GUN

[75] Inventor: Frank D. Marschka, Lancaster, Pa.

[73] Assignee: RCA Corporation, New York, N.Y.

[21] Appl. No.: 167,050

[22] Filed: Jul. 9, 1980

[51] Int. Cl.[3] ..... H01J 29/06; H01J 29/82; H01J 29/62

[52] U.S. Cl. ..... 313/451; 313/460; 313/313

[58] Field of Search ..... 313/460, 451, 450, 313, 313/448, 449

[56] References Cited

U.S. PATENT DOCUMENTS

| | | | |
|---|---|---|---|
| 2,545,120 | 3/1951 | Swedlund | 313/479 X |
| 3,201,637 | 8/1965 | Snyder | 313/451 X |
| 3,327,160 | 6/1967 | Schlesinger | 313/450 X |
| 3,376,448 | 4/1968 | Schwartz | 313/414 |
| 3,729,575 | 4/1973 | Harding et al. | 313/313 X |
| 3,892,992 | 7/1975 | Ishizuka | 313/449 X |
| 3,909,655 | 9/1975 | Grimmett et al. | 313/450 |
| 3,950,667 | 4/1976 | DeJong et al. | 313/450 |
| 4,287,450 | 9/1981 | Kawakami et al. | 313/449 X |

*Primary Examiner*—Palmer C. Demeo

*Attorney, Agent, or Firm*—Eugene M. Whitacre; Glenn H. Bruestle; Vincent J. Coughlin, Jr.

[57] ABSTRACT

An electron gun includes an electron beam source and at least two spaced apart successive electrodes. The successive electrodes are individually attached to, spaced from, and disposed concentric with and substantially within a ceramic cylinder. A resistive coating is uniformly disposed on at least an interior wall surface of the ceramic cylinder.

4 Claims, 2 Drawing Figures

MAIN LENS ASSEMBLY FOR AN ELECTRON GUN

This invention relates to an electrostatically focused electron gun for a cathode ray tube, and more particularly, to an electron gun having an improved bi-potential main lens assembly which provides shielding against spurious charges as well as reducing astigmatism and spherical aberration.

U.S. Pat. No. 3,376,448 to Schwartz, issued on Apr. 2, 1968, discloses a pair of shielding elements which extend radially outward from a focus electrode, G3 and an accelerating electrode, G4, towards the glass wall of the tube envelope. Each of the shield elements are located adjacent to a rolled edge of the respective G3 and G4 electrodes. The shield elements are provided to eliminate or reduce the lines of force which ordinarily emanate from the spurious electrostatic charges which forms on the envelope wall adjacent to the gap between the G3 and G4 electrodes. The spurious charges develop an electrostatic force pattern which extends through the gap between the aforementioned electrodes and adversely affect the electron beam by displacing it from its intended trajectory. A drawback of the Schwartz structure is the tendency for an arc to occur between the closely spaced shield elements. A further drawback is that the shield elements do not reduce or eliminate the adverse effects of spurious charge buildup on the conventional glass insulating rods which are commonly used to support the individual electron gun lens elements.

In certain types of cathode ray tubes, such as an electrostatically focused projection tube of the type disclosed in U.S. Pat. No. 2,545,120 to Swedlund, issued Mar. 13, 1951, the G4 acceleration electrode may comprise a semi-conductive coating disposed on the interior bulb wall. In such a tube, slight deviations from concentricity of the interior bulb wall will produce astigmatism in the relatively low energy electron beam exiting from the G3 focus electrode. The use of a highly concentric precision bore tubing for the G4 field forming neck portion of such tubes is one means of eliminating astigmatism; however, the use of precision glass increases the tube cost.

A resistive coating disposed on a surface of the glass support beads of a CRT electron gun to suppress arching is disclosed in the co-pending patent application of H. E. P. Schade, Ser. No. 153,970, filed May 28, 1980, assigned to the same assignee as the present invention and incorporated by reference herein. The Schade application does not address spurious electrostatic charge in the gap between the G3 and G4 electrode nor does it suggest the mutually concentric and aligned focus electrode and anode electrode lens elements that can be obtained by forming a G3-G4 main lens structure.

It is thus desirable to construct an electron gun which provides adequate shielding from spurious charges that may be formed both on the envelope wall as well as on the insulating support rods while providing a main lens assembly free from astigmatism caused by eccentricity of the electrode surface and from spherical aberration caused by electrode misalignment.

SUMMARY OF THE INVENTION

An electron gun includes an electron beam source and at least two spaced apart successive electrodes. The successive electrodes are attached to, spaced from, and disposed concentric with and substantially within a ceramic cylinder. A resistive coating is uniformly disposed on at least an interior wall surface of the cylinder.

DESCRIPTION OF THE PREFERRED EMBODIMENT

Figure 1:
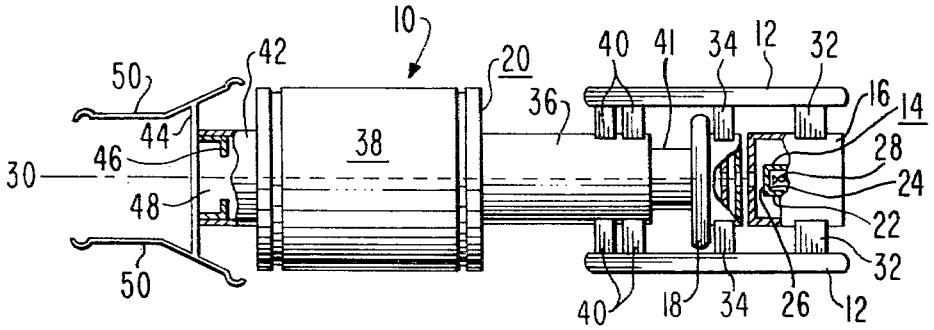
FIG. 1 is a longitudinal view partially broken away of the present novel electron gun structure.
Figure 2:
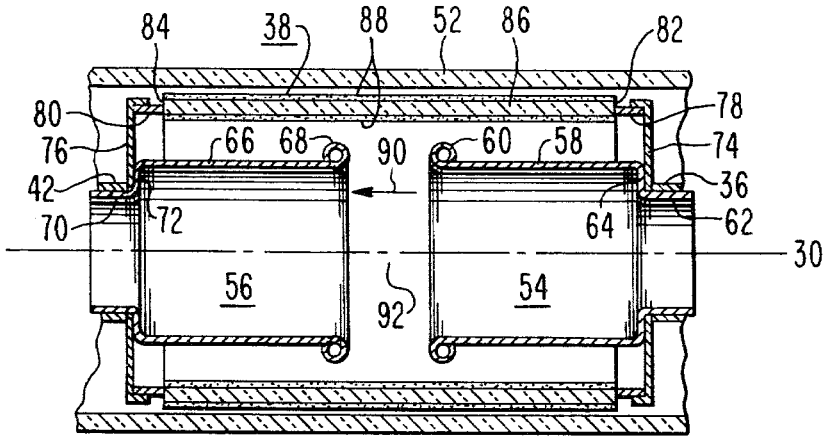
FIG. 2 is an enlarged sectional view of the novel main lens assembly of the electron gun of FIG. 1.

The details of an improved electron gun 10 are shown in FIGS. 1 and 2. The gun 10 comprises two glass support rods 12, also called beads, upon which various electrodes of the gun are mounted. These electrodes include, serially, in the order mentioned, an electron beam source 14, a control electrode 16, a screen electrode 18, and a main lens assembly 20.

The electron beam source 14 is conventional and may comprise a cathode sleeve 22 closed at the forward end by a cap 24 having an electron emissive coating 26 thereon. The cathode is indirectly heated by a heater coil 28 positioned within the sleeve 22. Electrical connections to the coil 28 are provided by connectors (not shown) well known in the art.

The control and screen electrodes 16 and 18, respectively, are two closely spaced elements having aligned apertures centered with the cathode coating 26 along the reference axis 30 of the tube. The control electrode 16 and the screen electrode 18 are attached to the support beads 12 by a pair of support studs 32 and 34 embedded in the support beads.

The main lens assembly 20 comprises a tubular shaped lower focus electrode member 36 and a main lens structure 38. The lower focus member 36 is attached to one end of the main lens 38, for example by welding, and to the support beads 12 by a plurality of support studs 40 embedded in the support beads. A constricted portion 41 of the lower focus member 36 extends within the screen electrode 18 and is closely spaced therefrom. An aperture in the constricted portion 41 is aligned with the apertures in the control and screen electrodes 16 and 18. A tubular anode extension member 42 is attached, for example by welding, to the other end of the main lens 38. A bulb spacer support member 44 is attached to the anode extension 42. The bulb spacer support member 44 has a support ledge 46 which telescopes within the anode extension 42 and defines an exit aperture 48. A plurality of bulb contacts 50 are attached to the bulb spacer member 44.

The novel main lens structure 38 of the main lens assembly 20 is shown in detail in FIG. 2. The main lens structure 38 is disposed adjacent to, but spaced from, an interior wall of an envelope 52 which comprises part of the cathode ray tube into which the electron gun is incorporated. The main lens structure 38 comprises a cylindrically shaped focus electrode 54 and a similarly, and preferably identically, shaped anode electrode 56. The focus electrode 54 includes a conductive tubular focus body 58 having an outwardly rolled edge 60 at one end and a coaxially extending focus lip 62 at the other end. A focus support shoulder 64 extends between the lip 62 and the tubular focus body 58. The lower focus member 36 is attached, for example by welding, to the focus lip 62. The anode electrode 56 comprises a similarly formed, tubular, conductive, anode body 66 having an outwardly rolled edge 68 at one end and a coaxially extending anode lip 70 at the other end. The anode extension 42 is attached, for example by welding, to the anode lip 70. An anode support shoulder 72 extends between the anode lip 70 and the anode body 66.

The focus electrode 54 and the anode electrode 56 are attached, for example by brazing, to a pair of identical, conductive, lens support members 74 and 76, respectively. The lens support members extend radially outward from the electrodes 54 and 56, respectively, and are attached, also by brazing, to a pair of metal cylindrical supports 78 and 80 which are attached, by brazing, to a metalized and plated surface on each of the oppositely disposed ends 82 and 84, respectively, of a main lens ceramic cylinder 86. The focus electrode 54 and the anode electrode 56 are disposed concentric with and substantially within the cylinder 86 so that the rolled edges 60 and 68, respectively, are adjacent to, but spaced apart from one another. The methods of forming metal-to-metal, and ceramic-to metal brazes are well known in the art and need not be described.

The ceramic cylinder 86 comprises a high alumina ceramic material suitable for use in cathode ray tubes. To prevent the formation of spurious electrostatic charge on the surfaces of the ceramic cylinder 86, a thin chrome oxide, $Cr_2O_3$, coating 88 having a resistance of at least about $10^{13}$ ohms per square is sprayed on the interior and exterior surfaces of the cylinder 86. The chrome oxide coating 88 should be uniformly applied and must extend to and make electrical contact with the metalized and plated ends 82 and 84 of the cylinder 86 to provide a continuous path for the transport of spurious charge. The use of the chrome oxide coating 88 on both the interior and exterior surfaces of the cylinder 86 provides a parallel path for the bleed-off of spurious electrostatic charge. It should be clear to one skilled in the art that while the parallel path is desirable, the coating 88 is only required on the interior surface of the cylinder 86 to prevent disruption of an electron beam 90 from the beam source 14 as it passes through a gap 92.

As shown in FIG. 2, the gap 92 is formed in the space between the focus electrode 54 and the anode electrode 56. In a projection tube, for example, the focus electrode 54 will operate at typically about 4 kV and the anode electrode will operate at typically about 30 kV. The voltages on the control electrode 16 typically range from a cutoff value of 120 volts negative to an operating value of 50 volts negative, with respect to the cathode. The screen electrode 18 typically operates at about 700 volts. The chrome oxide coating 88 on the main lens cylinder 86 permits bi-potential operation of the main lens structure 38 since the resistance of the coating is sufficiently great to withstand the voltage gradient while providing a bleed-off path to prevent the formation of spurious charges which would adversely affect the trajectory of the electron beam 90 as it crosses the gap 92. Furthermore, any spurious charge that forms on the wall of the envelope 52 is well shielded from the gap 92 by the cylinder 86.

The concentricity of the main lens cylinder 86, the focus electrode 54 and the anode electrode 56 substantially eliminates the astigmatism problem of the prior art by eliminating the bulb wall as the anode electrode. The present novel main lens structure 38 provides a concentric, accurately aligned succession of lens elements that was not possible in prior art structures where each individual lens element was attached to support beads by support members embedded in the beads, or where a lens element comprised a portion of the tube envelope. In Applicant's novel structure, the misalignment and the resulting spherical aberration resulting therefrom which was present in the prior art is reduced by decreasing the number of lens elements individually attached to the support beads 12, from four in the prior art, to three. Furthermore, the use of similarly, and preferably identically, shaped focus and and electrodes 54 and 56, respectively, brazed to identically shaped lens support members 74 and 76, assures the alignment of the parts within the main lens structure 38. Since the main lens assembly 20 is attached to the support beads 12 at a position on the lower focus member 36 remote from the main lens structure 38, any spurious electrostatic charging of the beads 12 cannot affect the trajectory of the electron beam 90 within the gap 92.

What is claimed is:

1. In an electron gun including an electron beam source and at least two spaced apart successive electrodes having coaxially aligned apertures therein for passing an electron beam therethrough, the improvement comprising:

a ceramic cylinder having interior and exterior surfaces and oppositely disposed ends, said cylinder having a resistive coating uniformly disposed on at least said interior surface thereof, said resistive coating contacting each of said oppositely disposed ends, and electrically conductive support means for attaching one of said successive electrodes to one of said oppositely disposed ends of said cylinder and another of said successive electrodes to another of said oppositely disposed ends, said support means being in contact with said resistive coating and said electrodes being spaced from, disposed concentric with and substantially within said ceramic cylinder.

2. In an electron gun for use in a cathode ray tube having a cylindrical envelope portion, said electron gun including, coaxially disposed along a reference axis within said cylindrical envelope portion, an electron beam source and a plurality of electrodes, said electrodes including serially in the order mentioned, a control electrode, a screen electrode, a focus electrode and an anode electrode, wherein the improvement comprises:

said focus electrode and said anode electrode being similarly shaped cylindrical members having coaxially extending lips at their remote ends and rolled edges at their adjacent ends;

a tubular lower focus electrode member attached to said lip of said focus electrode;

a tubular anode extension attached to said lip of said anode electrode;

a pair of electrically conductive support members attached to said remote ends of said focus electrode and said anode electrode and extending radially outward therefrom; and a ceramic cylinder having oppositely disposed metalized and plated ends with a resistive coating uniformly disposed on at least an internal surface thereof, said resistive coating being in electrical contact with said metalized and plated ends, said cylinder being disposed concentric with and surrounding said focus electrode and said anode electrode, said cylinder being attached at its two ends to said support members, said focus electrode and said anode electrode being disposed substantially within said ceramic cylinder, whereby said resistive coating on said ceramic cylinder provides electrostatic charge shielding by preventing charge buildup in the space between said focus electrode and said anode electrode and by shielding said space from charge buildup accumulating on a wall surface of said envelope.

3. The electron gun as defined in claim 2 wherein the resistive coating has a resistance value of at least about $10^{13}$ ohms per square so as to permit the focus electrode and the anode electrode to operate independently of each other.

4. The electron gun as defined in claim 2 wherein the resistive coating is disposed on both an exterior surface and said internal surface of said ceramic cylinder.

* * * * *

UNITED STATES PATENT AND TRADEMARK OFFICE

CERTIFICATE OF CORRECTION

PATENT NO. : 4,350,925

DATED : 9/21/82

INVENTOR(S) : Frank David Marschka

It is certified that error appears in the above-identified patent and that said Letters Patent is hereby corrected as shown below:

Column 4, Line 7 - "focus and and" should be -- focus and anode -- .

Signed and Sealed this

*Twenty-eighth* Day of *December 1982*

[SEAL]

*Attest:*

GERALD J. MOSSINGHOFF

*Attesting Officer*

*Commissioner of Patents and Trademarks*